US008674203B2

(12) United States Patent
Simon

(10) Patent No.: US 8,674,203 B2
(45) Date of Patent: Mar. 18, 2014

(54) HEEL-DRIVEN PEDAL FOR A PERCUSSION INSTRUMENT

(76) Inventor: Michael Robert Simon, Sycamore, IL (US)

( * ) Notice: Subject to any disclaimer, the term of this patent is extended or adjusted under 35 U.S.C. 154(b) by 327 days.

(21) Appl. No.: 13/102,861

(22) Filed: May 6, 2011

(65) Prior Publication Data

US 2011/0271818 A1 Nov. 10, 2011

Related U.S. Application Data

(60) Provisional application No. 61/333,118, filed on May 10, 2010.

(51) Int. Cl.
*G10D 13/02* (2006.01)

(52) U.S. Cl.
USPC ..... 84/422.1

(58) Field of Classification Search
USPC ..... 84/422.1
See application file for complete search history.

(56) References Cited

U.S. PATENT DOCUMENTS

| | | | | |
|---|---|---|---|---|
| 1,775,283 | A | 9/1930 | Juster | |
| 2,484,302 | A | 10/1949 | Laverents | |
| 2,845,830 | A | 8/1958 | Haviland | |
| 3,677,128 | A | 7/1972 | Simpson | |
| 3,967,523 | A | 7/1976 | Currier et al. | |
| 3,988,957 | A | 11/1976 | Escamilla | |
| 4,134,325 | A | 1/1979 | Loftus | |
| 4,873,910 | A | 10/1989 | Kurosaki | |
| 4,958,549 | A * | 9/1990 | Vukovic | 84/422.1 |
| 5,355,761 | A | 10/1994 | Ward et al. | |
| 5,458,039 | A | 10/1995 | Ashby | |
| 5,866,830 | A | 2/1999 | Onyszkanycz | |
| 5,877,441 | A * | 3/1999 | Labute | 84/422.1 |
| 6,002,076 | A * | 12/1999 | Karn | 84/422.1 |
| 6,271,450 | B1 * | 8/2001 | Mackie | 84/422.1 |
| 6,307,136 | B1 * | 10/2001 | Sikra et al. | 84/422.1 |
| 6,762,354 | B2 * | 7/2004 | Cocca | 84/422.1 |
| 7,135,633 | B2 * | 11/2006 | Miyajima et al. | 84/422.1 |

* cited by examiner

*Primary Examiner* — Christopher Uhlir
(74) *Attorney, Agent, or Firm* — Pauley Petersen & Erickson

(57) ABSTRACT

A heel-driven drum pedal system for playing a primary percussion instrument and a secondary percussion instrument. The heel-driven drum pedal system includes a heel-driven pedal that strikes the secondary percussion instrument with a separate beater unit connected to the heel-driven pedal with an extension rod. The heel-driven pedal further including at least one cut-out, allowing the heel-driven pedal to be coupled to a standard toe-driven drum pedal for the primary percussion instrument. The heel-driven pedal coupled to the toe-driven drum pedal so that both pedals can be operated with one foot.

15 Claims, 7 Drawing Sheets

HEEL-DRIVEN PEDAL FOR A PERCUSSION INSTRUMENT

BACKGROUND OF THE INVENTION

1. Field of the Invention

The present invention relates to an actuator for percussion instruments, such as a single-bass drum, a double-bass drum, a cow bell, a block, a cymbal, or a hi-hat. More specifically, to a heel driven pedal which, when combined with a toe driven pedal, allows multiple percussion instruments to be played with one foot.

2. Discussion of Related Art

Commonly known drum pedals comprise a hinged pedal, which is toe-driven, for striking a bass drum or another percussion instrument. These known drum pedals utilize a mallet or a beater which is driven with a spring/pivotal apparatus comprising a rod with a bearing positioned between one or two pedestals or towers. Such drum pedals are taught by Juster, U.S. Pat. No. 1,775,283, Currier et al., U.S. Pat. No. 3,967,523, Loftus, U.S. Pat. No. 4,134,325, and Kurosaki, U.S. Pat. No. 4,873,910.

Another type of known drum pedals operates in a double bass drum application. These double bass drum pedals use a rod and a universal joint assembly to connect two pedals to strike a percussion instrument with two beaters. Such a drum pedal is taught by Hailand, U.S. Pat. No. 2,845,830.

While most common drum pedals are operated by pressure of the front or toe part of the foot, some known drum pedals utilize other portions of the foot, such as a heel. Layerants, U.S. Pat. No. 2,484,302, teaches a drum pedal which is hinged in a center of the pedal. This drum pedal utilizes the downward movement of the heel and the toe to actuate a pair of beaters to strike a drum. Ward et al., U.S. Pat. No. 5,355,761 teaches a heel-driven pedal assembly that operates a hi-hat assembly using a complex pulley system. Ashby, U.S. Pat. No. 5,458,039, teaches a heel-driven assembly that actuates a forward, front beater to strike a frontward bass drum using a hinge and a belt system. The Ashby Patent uses the heel, rather than the toe, to strike the drum in a forward motion to reduce fatigue of the musician. Onyszkanycz, U.S. Pat. No. 5,866,830 teaches a heel-driven pedal that actuates a beater to strike a frontward bass drum. However, none of these pedals can be utilized in combination with a standard toe-driven pedal.

Other types of known drum pedals utilize a hinge between a toe-driven pedal and a heel-driven pedal. Karn U.S. Pat. No. 6,002,076 and Escamilla U.S. Pat. No. 3,988,957 both teach such a system wherein both the toe-driven pedal and the heel-driven pedal actuate a pair of beaters which strike a single drum. These systems also cannot be utilized in combination with a standard toe-driven pedal.

Similarly, Simpson, U.S. Pat. No. 3,677,128, teaches a system that utilizes a hinge between a toe-driven pedal for a front drum and a heel-driven pedal for a rear drum. This system has a shortcoming in that, because of the proximity of the rear drum, the musician's seat or "throne" interferes with the placement of the system thus making playing the instrument awkward. Further, this system cannot be utilized in combination with a standard toe-driven pedal.

Accordingly, there is a need for a heel-driven drum pedal which can combined with a standard toe-driven drum pedal without the limitations or complexities of known drum pedals.

SUMMARY OF THE INVENTION

This invention provides a heel-driven pedal for a percussion instrument. Combining this invention with a standard toe-driven drum pedal provides a system which allows a musician to operate a plurality of percussion instruments with one foot. Providing the musician with the ability to create complex rhythmic patterns and/or poly-rhythm patterns.

The standard toe-driven drum pedal can be selected by the musician, based on his or her tastes and/or needs, to operate a primary percussion instrument for example, but not limited to, a single-bass drum, a double-bass drum, a cow bell, a block, a cymbal and a hi-hat.

The heel-driven pedal according to one embodiment of this invention includes a heel board connected to a base plate with a hinge. At least one of the heel board and the base plate includes a cut-out. The cut-out allows a portion of the standard toe-driven drum pedal to be mated within the heel-driven pedal so that the musician's foot can be placed over the heel-driven pedal and the standard toe-driven pedal simultaneously, allowing the musician to comfortably operate each pedal. In a preferred embodiment, the heel-driven pedal and the toe-driven pedal can be slid closer and/or further apart from one another allowing the drum pedal system of this invention to accommodate differently sized feet. Additionally, because the standard toe-driven drum pedal is positioned on top of a portion of the base plate of the heel-driven pedal, pressure exerted on the standard toe-driven pedal by the musician's foot causes the heel pedal, though not technically attached, to remain solidly in place without slippage. In another embodiment, the heel-driven pedal is retained in a position with a screw retaining spike positioned within a notch in the base plate of the heel-driven pedal.

In a preferred embodiment, the heel board and the base plate have a "forked" design with a pair of hinges, each hinge positioned on each side of the cut-out. This "forked" design allows the surface of the heel board to be short enough allowing for the toe and heel to be comfortably used simultaneously.

In an embodiment of this invention, the heel board and the hinge are offset from the base plate by a spacer. In a preferred embodiment, the spacer is a plurality of washers held in place with a screw. The washers can be added or removed to adjust the offset of the spacer, thereby allowing a musician to adjust a height and/or an angle of the heel board to a comfortable and ergonomic position.

The heel-driven pedal of this invention further includes a pedestal mounted to the base plate at a position opposite the hinge. The pedestal includes at least one pedestal tower which supports a bearing rod in a rotatable connection. In a preferred embodiment, the rotatable connection is provided by a heel-driven pedal bearing housing between the pedestal tower and the bearing rod.

In an embodiment of this invention, a sprocket connects to the bearing rod with a friction fit and a chain extends from the sprocket to the heel board. In operation, as the heel board is pressed towards the base plate, the chain pulls on and rotates the sprocket and the bearing rod.

Opposite of the sprocket, the bearing rod connects to an extension rod with a first universal joint, such that, as the bearing rod rotates the extension rod also rotates. The universal joint allows the extension rod to be positioned at a variety of angles to the bearing rod allowing a secondary percussion instrument to be positioned away from the seat or throne of the musician. The extension rod provides versatility in that the heel-driven pedal of this invention may be combined with a variety of instruments of various sounds and sizes.

On an other end of the extension rod, the extension rod connects to a beater unit which operates the secondary percussion instrument for example, but not limited to, a single-bass drum, a double-bass drum, and a hi-hat.

In a preferred embodiment, the beater unit includes a beater pedestal mounted to a beater base plate. The beater pedestal includes at least one beater pedestal tower that supports a beater bearing rod in a rotatable connection. In a preferred embodiment, the rotatable connection is provided by a beater unit bearing housing between the beater pedestal tower and the beater bearing rod.

One end of the beater bearing rod connects to the extension rod, described above, with a second universal joint. The second universal joint allows the beater unit to be positioned at a variety of angles to the extension rod, thereby improving the versatility and positionability of this invention.

An other end of the beater bearing rod connects to a beater positioned near the secondary percussion instrument. In a preferred embodiment, the beater includes a beater shaft and a mallet.

In operation, the musician presses his or her heel into the heel board towards the base plate pulling on the chain. The chain rotates the sprocket and the bearing rod. In turn, the bearing rod turns the extension rod which turns the beater bearing rod causing the beater to strike the secondary percussion instrument with the mallet.

In an embodiment of this invention at least one of the heel-driven pedal and the beater unit includes a biasing element that biases the beater in a non-striking or starting position, such that as the heel is lifted from the heel board the beater returns to the starting position. In a preferred embodiment, the beater unit includes a biasing element which includes a spring and an anchor point. The spring is positioned between the beater bearing rod and the anchor point such that, as the beater bearing rod rotates, a tension on the spring increases. In embodiment of this invention, the anchor point includes a means of adjusting an initial tension on the spring in a starting position.

The system of this invention provides numerous features not provided by previously known drum pedals. For example, the heel-driven pedal of this invention is designed to be combined with any standard toe-driven pedal without impeding an action of the standard toe-driven pedal due to a non-attached concept of the pedal design. A portion of the heel-driven pedal slips under and/or around the standard toe-driven pedal and can be adjusted by sliding the heel-driven pedal base back and forth to a comfortable ergonomic position of a musician's choosing.

The system of this invention provides playability that is similar to the standard way of playing a drum set. The standard position for playing the drums involves maintaining the heel off the ground. Placement of the heel-driven pedal of this invention under the raised heel does not affect the standard way of playing while opening up a new method for polyrhythmic drumming. This invention is beneficial to both a beginner just learning coordination and an advanced drummer wishing to supplement his/her musicianship.

BRIEF DESCRIPTION OF THE DRAWINGS

These and other objects and features of this invention will be better understood from the following detailed description taken in conjunction with the drawings, wherein.

DESCRIPTION OF PREFERRED EMBODIMENTS

Figure 1:
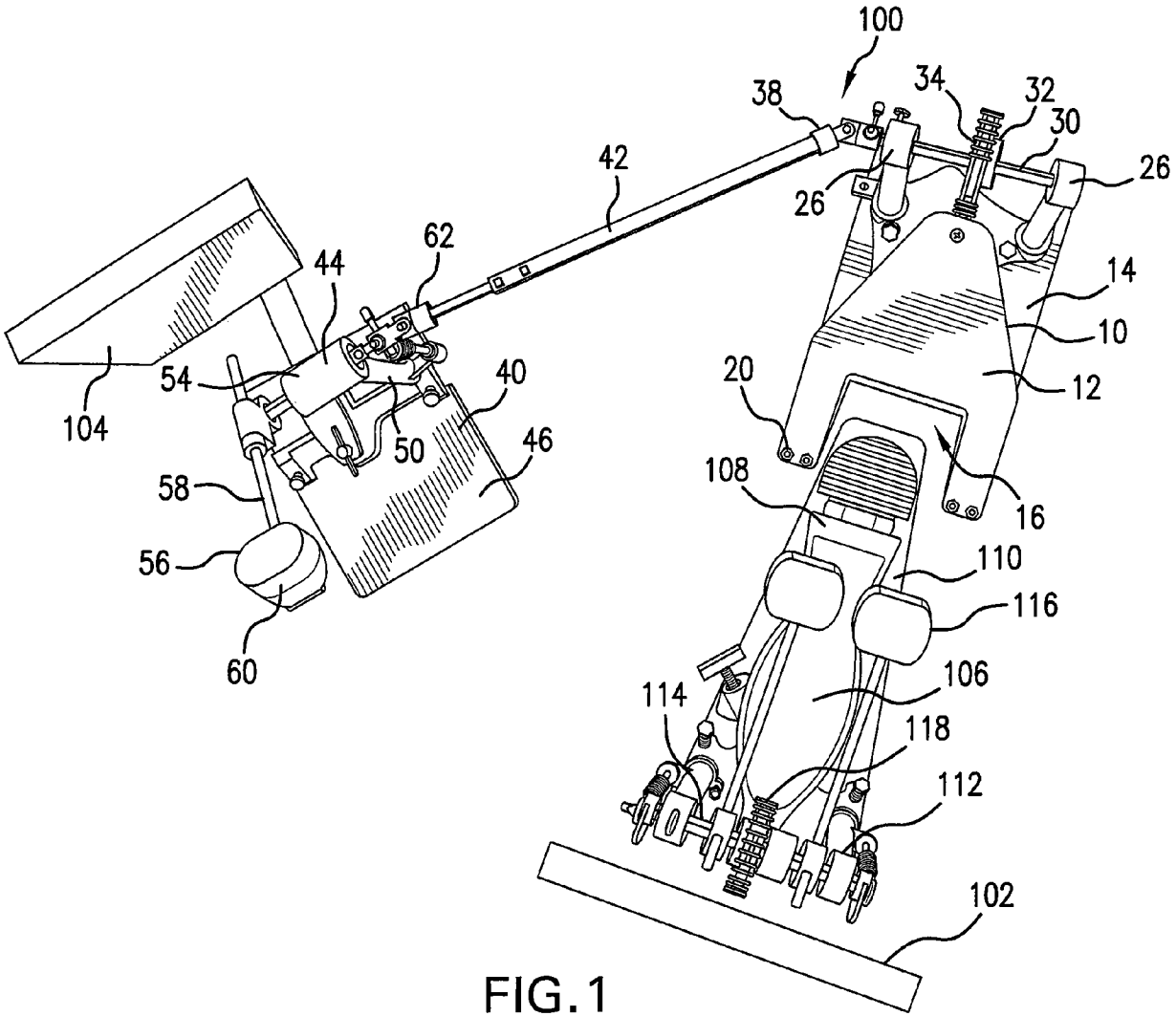
FIG. 1 is a top view of a drum pedal system according to one embodiment of this invention.

FIG. 1 shows a system 100 for operating a plurality of percussion instruments 102, 104 simultaneously with one foot. The system 100 of this invention includes a heel-driven pedal 10 combined with a toe-driven pedal 106 in an overlapping orientation. With this orientation the heel-driven pedal 10 can be retrofit to any standard toe-driven drum pedal that best suits a musician's needs.

In FIG. 1, the standard toe-driven drum pedal 106 is positioned in front of a primary percussion instrument 102, for example a bass drum. The standard toe-driven pedal 106 selected in this embodiment comprises a footboard 108 hingely connected to a base plate 110. Mounted to the base plate 110 is a pair of pedestals 112 which support, in a rotatable connection, an axle 114 and a beater 116. The footboard 108 is connected to one end of a chain 118 and an other end of the chain 118 is connected to the axle 114. In operation, as the musician presses the footboard 108, the chain 118 rotates the axle 114 causing the beater 116 to strike the primary percussion instrument 102.

FIG. 1 provides an example of the standard toe-driven drum pedal 106 that may be combined with the invention of this application. However, this invention is not intended to be limited to such a standard toe-driven drum pedal and may be combined with any type of drum pedal that suits the musician's needs. Additionally, in this embodiment, the primary percussion instrument 102 is a single-bass drum. However, the primary percussion instrument 102 can be any type of percussion instrument including, but not limited to, a double-bass drum, a hi-hat, a block, a cymbal and a cow bell.

Figure 2:
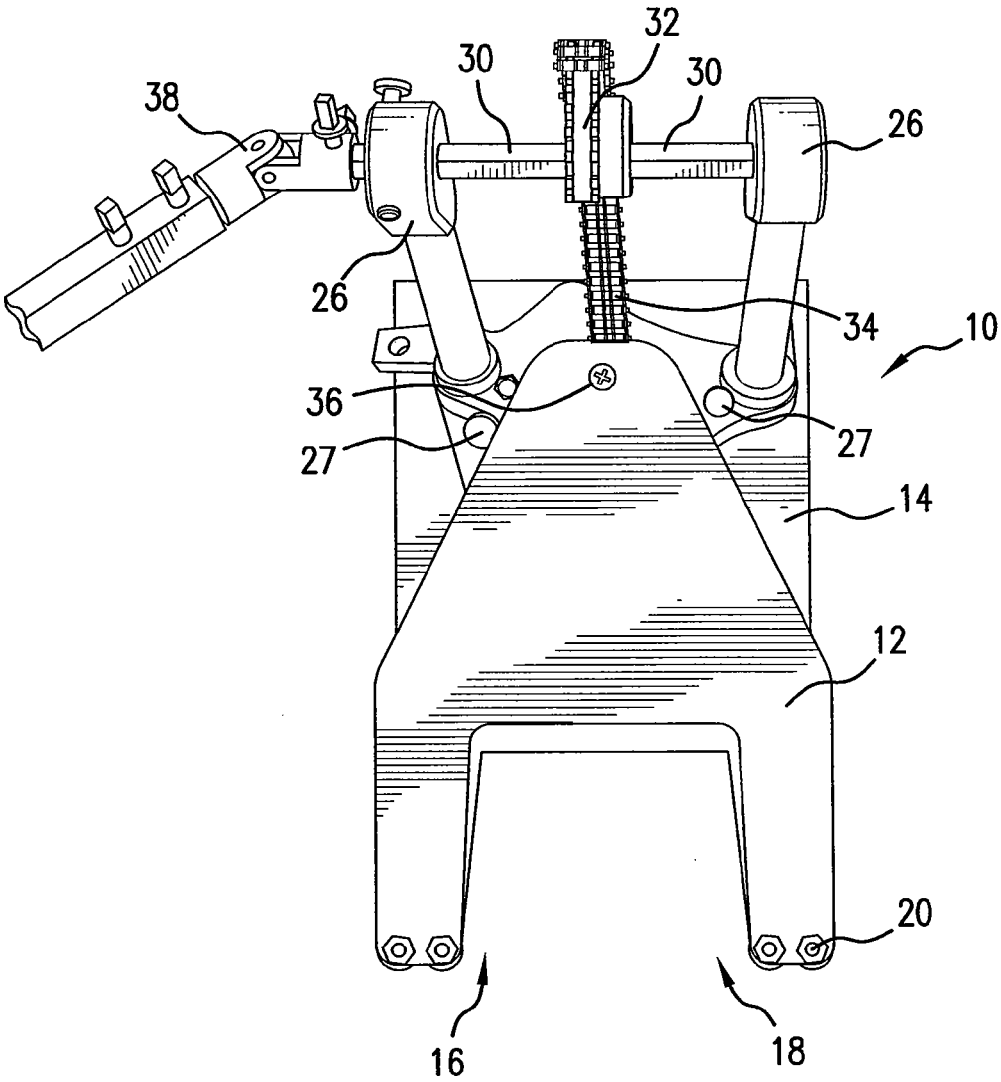
FIG. 2 is a top view of a heel-driven pedal of the drum pedal system of FIG. 1.

The remainder of this application is directed to the components that allow a musician to play a secondary percussion instrument 104 with the heel-driven pedal 10. FIG. 2 shows a top view of the heel-driven pedal 10 according to one embodiment of this invention. In this embodiment, the heel-driven pedal 10 includes a heel board 12 hingely connected to a base plate 14. In a preferred embodiment, the heel-driven pedal 10 is manufactured from billet aluminum. Alternatively, the heel-driven pedal 10 can be manufactured from any material capable of withstanding the repeating stress caused by the pounding of a musician's heel, such as, for example, steel, titanium and composite materials.

As described above, the heel-driven pedal 10 is coupled with the standard toe-driven pedal 106. In a preferred embodiment, at least one of the heel board 12 and the base plate 14 includes a cut-out which allows the heel-driven pedal 10 to be coupled and/or positioned in proximity to the standard toe-driven drum pedal 106.

Figure 3:
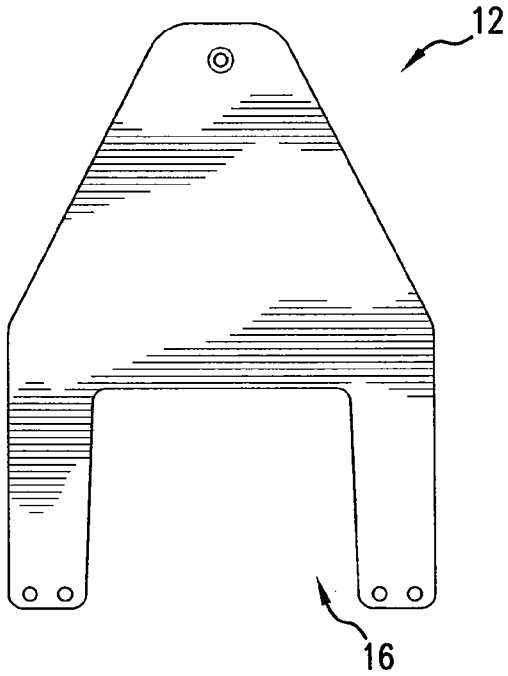
FIG. 3 is a top view of a heel board of the heel-driven pedal of FIG. 2.

FIG. 3 shows a top view of the heel board 12 according to one embodiment of this invention. In this embodiment, the heel board 12 includes a pentagon-like shape with a heel board cut-out 16 having a trapezoid-like shape. However, the heel board 12 can have any shape necessary for an application including, but not limited to, a triangle shape, a square shape and a circular shape. Additionally, the heel board cut-out 16 can have any shape necessary to accommodate any type of the toe-driven pedal including, but not limited to, a triangle shape and a square shape.

Figure 4:
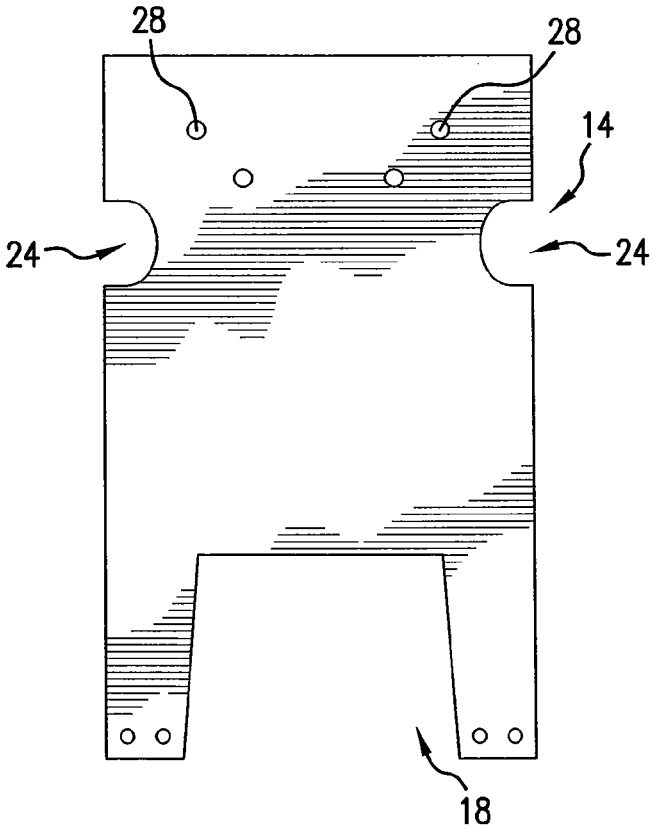
FIG. 4 is a top view of a base plate of FIG. 2.

FIG. 4 shows a top view of the base plate 14 according to one embodiment of this invention. In this embodiment, the base plate 14 includes a generally rectangular shape with a base plate cut-out 18 having a trapezoid-like shape and a pair of side notches 24. However, the base plate 14 is not limited to a generally rectangular shape and may have any shape necessary to support heel-driven pedal 10 including, but not limited to a triangle, a square, a diamond and a circular shape. Additionally, the base plate cut-out 18 can have any shape necessary to accommodate any type of the toe-driven pedal including, but not limited to, a triangle shape and a square shape.

In a preferred embodiment, the heel board cut-out 16 and the base plate cut-out 18 have similar shapes in order to accommodate any type of the toe-driven pedal. Alternatively, the heel board cut-out 16 and the base plate cut-out 18 may have different shapes in order to accommodate any type of the toe-driven pedal.

As shown in FIG. 1, the heel board cut-out 16 and the base plate cut-out 18 are shaped to accommodate a portion of the standard toe-driven drum pedal 106. In an embodiment of this invention, a portion of the base plate 110 of the standard toe-driven drum pedal 106 overlaps a portion of the base plate 14 of the heel-driven pedal 10. With this arrangement pressure on the standard toe-driven drum pedal 106 operates to hold the heel-driven pedal 10 in place. Additionally, in an embodiment of this invention, a portion of the heel board 12 overlaps a portion of the foot board 108 of the standard toe-driven drum pedal 106. With this arrangement, the system 100 can be adjusted to accommodate any sized foot by sliding the heel-driven pedal 10 back and forth with respect to the standard toe-driven drum pedal 106.

The positioning of the heel-driven pedal 10 to the standard toe-driven drum pedal 106 can be secured with the addition of a spike stabilizer through a portion of the base plate 14 of the heel-driven pedal 10. As shown in FIG. 4, the base plate 14 includes a pair of side notches 24 which accept a pair of spike stabilizers (not shown) to secure the base plate 14 in a desired position and preventing the heel-driven pedal 10 from slipping backwards away from the standard toe-driven pedal 106.

Figure 5:
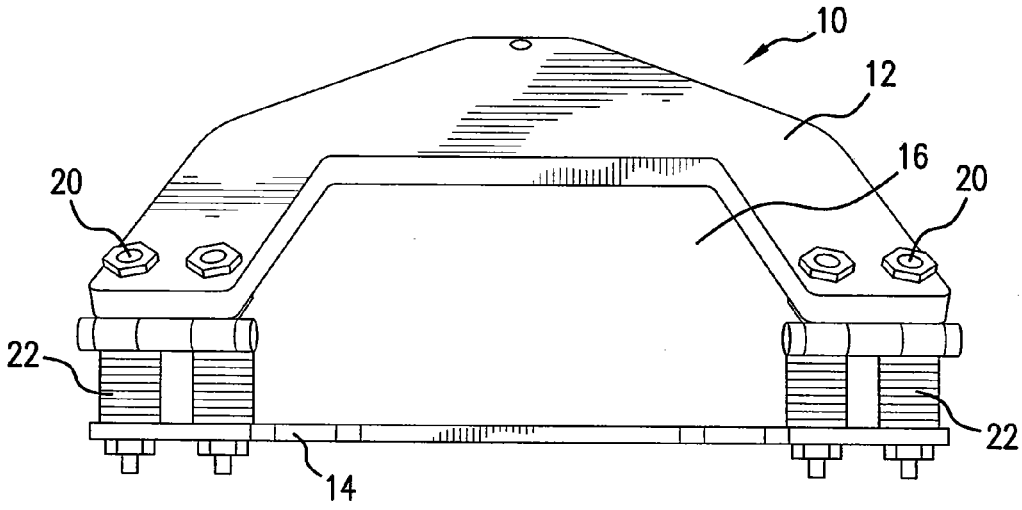
FIG. 5 is a rear view of the heel board and the base plate of the drum pedal system of FIG. 1.
Figure 6:
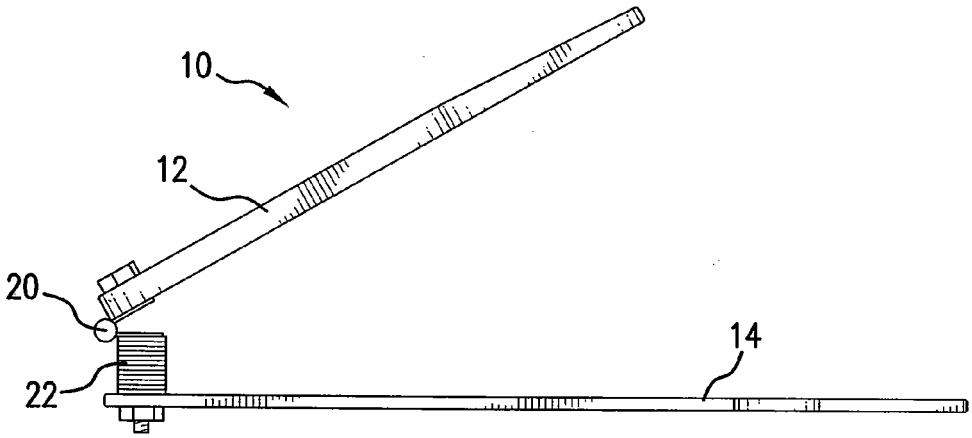
FIG. 6 is a side view of the heel board and the base plate of the drum pedal system of FIG. 1.

FIGS. 5 and 6 show a rear view and a side view of the heel board 12 and the base plate 14 according to an embodiment of this invention. In this embodiment, the heel board 12 is connected to the base plate 14 with a hinge 20. In this embodiment, the heel board 12 includes a plurality of holes for mounting the hinge 20 with a fastener such as but not limited to a screw, a nut and bolt or a rivet. Similarly, the base plate 14 includes a plurality of holes for mounting the hinge with a fastener. Alternatively, the hinge 20 may be mounted to heel board 12 and to the base plate 14 with a weld or an adhesive connection. In an embodiment of this invention, the hinge 20 comprises a plurality of hinges 20. In a preferred embodiment, as shown in FIG. 5, the heel board 12 and the base plate 14 have a "forked" design with at least one hinge 20 positioned on either side of the heel board cut-out 16 and the base plate cut-out 18. With this arrangement, the heel-driven pedal 10 has a robust and durable hinged connection between the heel board 12 and the base plate 14 while providing space between the hinges 20 for the standard toe-driven drum pedal 106.

In a preferred embodiment, the heel board 12 is biased in an upward position shown in FIGS. 5 and 6. In operation, a musician's heel presses the heel board 12 downwards towards the base plate 14 to strike the second percussion instrument 104.

As shown in FIGS. 5 and 6, the heel board 12 and the hinge 20 are offset from the base plate 14 by a spacer 22. In a preferred embodiment, the spacer 22 is adjustable in height allowing the musician to customize the heel board 12 to a preferred ergonomic position. Further, the adjustable height allows the heel-driven pedal 10 to be adjusted to compensate for various-sized toe-driven pedals 106 that the heel-driven pedal 10 may be mated with. In the embodiment of FIGS. 5 and 6, the spacer 22 comprises a plurality of washers placed around the screws that attach the heel board 10 to the base plate 14. With this arrangement, washers can be added and/or removed to change the height of the spacer 22.

As shown in FIG. 2, a pedestal 26 is mounted to the base plate 14 with a plurality of fasteners 27 in a plurality of holes 28 in the base plate 14. Alternatively, the pedestal 26 can be mounted to the base plate 14 with a weld or adhesive connection. In still another embodiment, the pedestal 26 can be integrally formed with base plate 14. In the embodiment shown in FIG. 2, the heel-driven pedal 10 includes a pair of pedestals 26 with a bearing rod 30 extending therebetween. In an alternative embodiment, the heel-driven pedal 10 includes a single pedestal 26 that supports the bearing rod 30.

In a preferred embodiment, the bearing rod 30 is connected to the pedestal 26 via a bearing, not shown, permitting the bearing rod 30 to easily rotate in the pedestal 26. In this embodiment, the bearing rod 30 comprises a hexagon shape cross-section, alternatively the bearing rod 30 may comprise any shape cross section. In an embodiment of this invention, the bearing rod 30 is connected to a spring device that biases the bearing rod in a starting position.

As shown in FIG. 2, a sprocket 32 is coupled to the bearing rod 30. The sprocket 32 includes a hexagon shaped hole that corresponds to a cross-section shape of the bearing rod 30. These hexagon shapes allow the sprocket 32 and bearing rod 30 to rotate as a unit, preventing the sprocket 32 from rotating independent of the bearing rod 30. The sprocket 32 further includes a set of teeth that engage a chain 34 that extends to the heel board 12. In the embodiment of FIG. 2, the chain 34 is mounted to the heel board 12 with a fastener through a hole 36 in the heel board 12. The fastener is preferably a screw, bolt or rivet, alternatively the fastener may be replaced with a weld or an adhesive connection. In an alternative embodiment, the chain 34 is replaced with a belt that extends from the heel board 12 and wraps around the bearing rod 30. In this alternative embodiment, the sprocket 32 may be omitted or alternatively included without the teeth.

As shown in FIGS. 1 and 2, the bearing rod 30 extends through the pedestal 112 and connects to an extension rod 42 with a first universal joint 38. In operation, a musician's heel presses the heel board 12 downwards towards the base plate 14, this motion draws the chain 34 downward rotating the sprocket 32 and the bearing rod 30, which rotates the first universal joint 38 and the extension rod 42 causing the beater unit 40 to strike the secondary percussion instrument 104. The first universal joint 38 provides a flexible connection between the heel-driven pedal 10 and the extension rod 42, allowing the beater unit 40 to be moved and placed in various positions and to compensate for the position of other equipment and the musician's seat.

Figure 7:
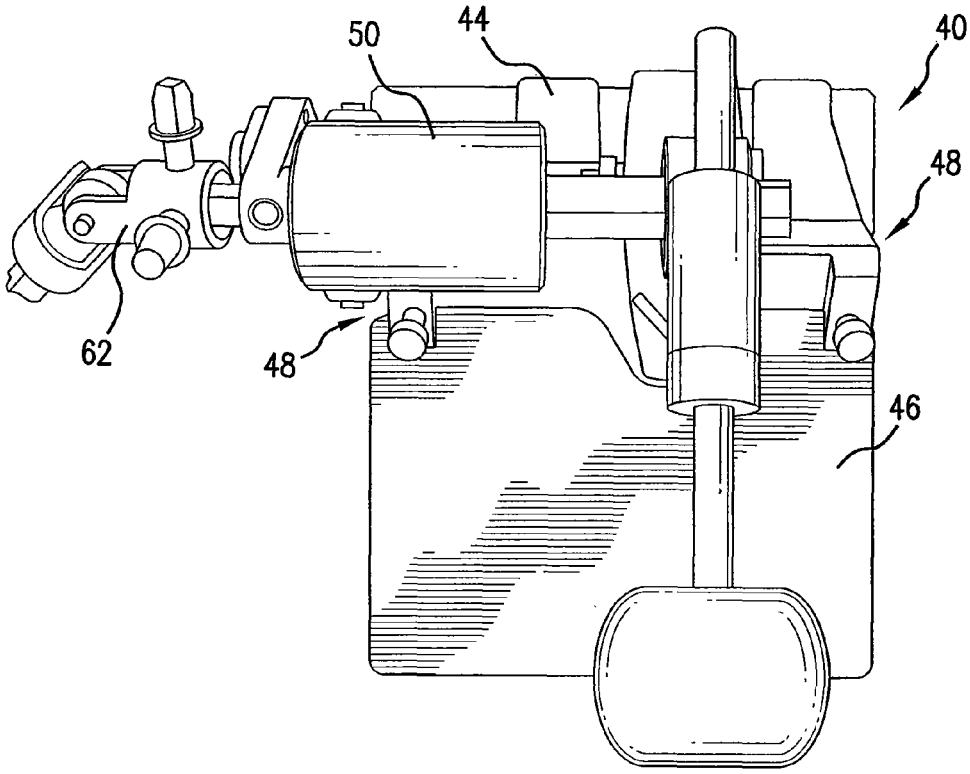
FIG. 7 is a top view of a beater unit of the drum pedal system of FIG. 1.

As shown in FIG. 7, the beater unit 40 includes a beater unit pedestal 44 and a beater unit base 46. The beater unit pedestal 44 is mounted to the beater unit base 46 with a plurality of fasteners, such as, for example, screws, bolts or rivets. Alternatively, the beater unit pedestal 44 is mounted to the beater unit base 46 with a weld or an adhesive connection. In another embodiment, the beater unit pedestal 44 and the beater unit base 46 are integrally formed as a single unit. Preferably, the beater unit 40 is manufactured from a durable material that is capable of withstanding repeating striking motion of a musician playing the drums, such as, but not limited to, billet aluminum, steel, titanium and composite materials.

Figure 10:
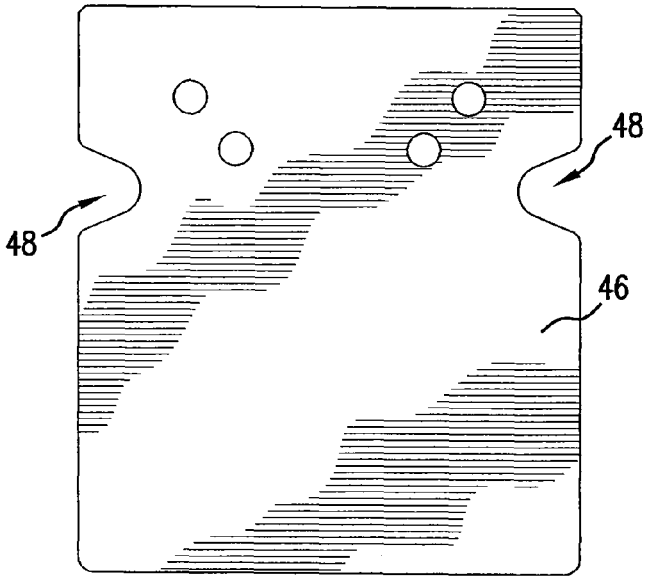
FIG. 10 is a top view of the base of the beater unit of FIG. 7.
Figure 9:
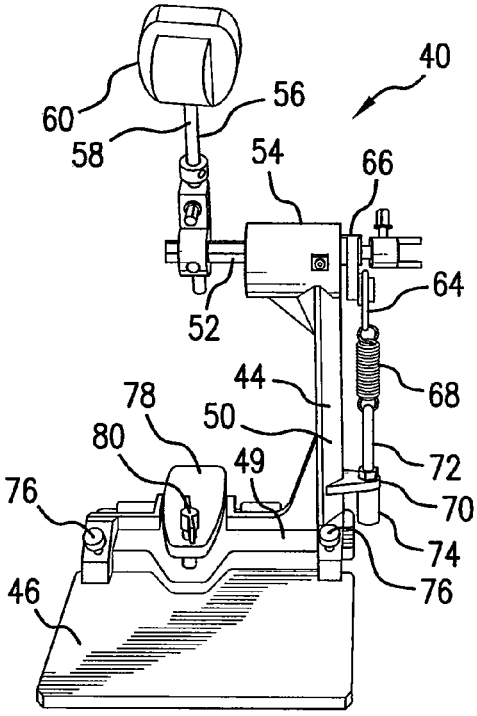
FIG. 9 is a front view of the beater unit of FIG. 7.

As best shown in FIGS. 7 and 10, the beater unit base 46 is preferably has a generally rectangular shape capable of stabilizing the beater unit 40 during play, however, the beater unit base 46 can have any shape capable of stabilizing the beater unit 40. As shown in FIG. 10, the secondary unit base 46 includes a plurality of holes for attaching the secondary unit pedestal 44. Further, the secondary unit base 46 includes a pair of side notches 48 to accommodate stabilizing spike screws 76. FIG. 9 shows the stabilizing spike screws 76 extending through the side notches 48. With this arrangement, the beater unit 40 is secured in a position and will not slide or moved while being played. Alternatively, the secondary base unit 46 can be designed without the side notches 48.

Figure 8:
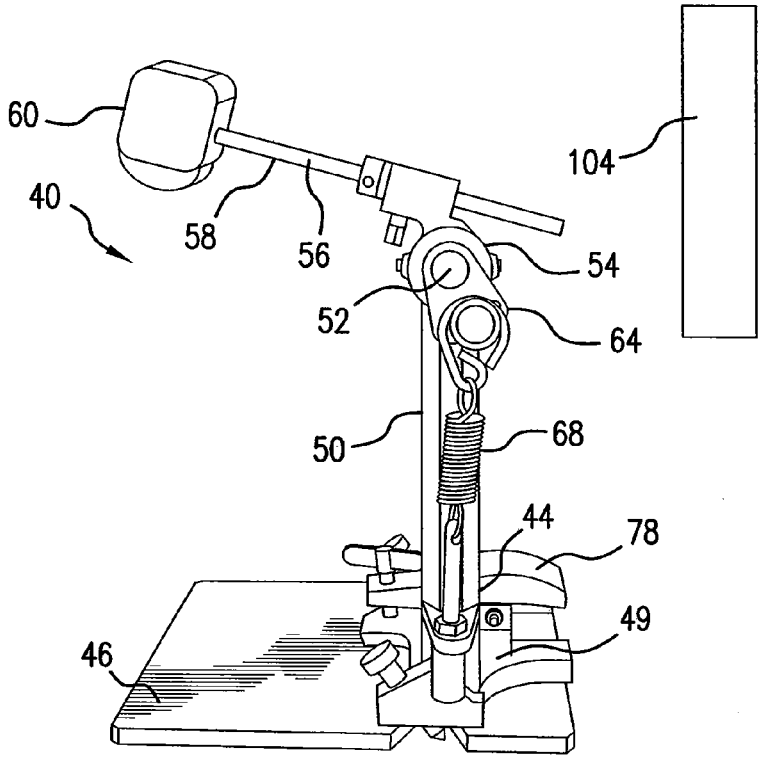
FIG. 8 is a side view of the beater unit of FIG. 7.

As best shown in FIGS. 8 and 9, the beater unit pedestal 44 includes a pedestal base 49 supporting a pedestal tower 50 with a bearing housing 54 positioned on the pedestal tower 50 opposite from the base 46. In an alternative embodiment, the beater unit pedestal 44 includes a plurality of pedestal towers.

A secondary unit bearing rod 52 is rotatably connected to the bearing housing 54. Like the bearing rod 30 of the heel-driven pedal 10, the beater unit bearing rod 52 comprises a hexagon cross-section shape, alternatively the beater unit bearing rod 52 may comprise any shape cross section.

A shown in FIG. 9, the beater unit bearing rod 52 extends beyond each edge of the bearing housing 54. A first end of the beater unit bearing rod 52 attaches to a beater 56 which is used to strike the secondary percussion instrument 104. The beater 56 includes a beater shaft 58 and a mallet 60. The beater shaft 58 is preferably manufactured durable material that is capable of withstanding repeating striking motion of a musician playing the drums, such as, but not limited to, billet aluminum, steel, titanium and composite materials. The mallet 60 can be manufactured from a variety of materials including but not limited to, felt, plastic, phenolic, rubber and yarn, each material capable of imparting a distinctive sound on a particular percussion instrument.

The second end of the beater unit bearing rod 52 connects to a second universal joint 62 and a biasing element 64. The second universal joint 62 connects to the beater unit 40 to the extension rod 42 which connects to the heel-driven pedal 10 as described above. The second universal joint 62 provides a flexible connection between the beater unit 40 and the extension rod 42, allowing the beater unit 40 to be moved and placed in front of various instruments.

The biasing element 64 is designed to return the mallet 60 to a starting position after the musician lifts his foot off the heel-driven pedal 10. In the embodiment shown in FIGS. 8 and 9, the biasing element 64 includes a disk 66 and a spring 68. The spring 68 is attached at a first end at a radius of the disk 66 and at a second end to an anchor 70. In the embodiment shown in FIGS. 8 and 9, the anchor 70 includes a retaining screw 72 and a lock nut 74. The retaining screw 72 and the lock nut 74 provide a means for increasing or decreasing a tension on the spring 68 and the bias applied to the beater unit 40. In an alternative embodiment, the biasing element 64 is incorporated into the bearing housing 54.

In an embodiment of this invention, the disk 66 connects to the beater unit bearing rod 52 with a fastener such as a hex-nut screw, alternatively the connection may include a friction fit, an adhesive or a weld. The disk 66 preferably includes a hole with a shape that matches a cross section of the beater unit bearing rod 52. In an embodiment of this invention, the hole has a hexagon shape that matches a hexagon cross section of the bearing rod 52.

In a preferred embodiment of this invention the beater unit is secured to the secondary percussion instrument 104 with a clamp 78 to prevent the beater unit from sliding away from the secondary percussion instrument during play. As shown in FIGS. 8 and 9, a portion of the clamp 78 extends over a portion pedestal base 49 and secured in place with a wing nut 80. An other side of the clamp 78 secured to the secondary percussion instrument 104.

In operation, the musician presses his or her heel into the heel board 12 towards the base plate 14, this action pulls on the chain 34. The chain 34 in turn rotates the sprocket 32 and the bearing rod 30. The rotating bearing rod 30 transfers energy through the extension rod 42 to the beater unit bearing rod 52, rotating the beater unit bearing rod 52 and causing the beater 56 to strike the secondary percussion instrument 104 with the mallet 60. Releasing heel pressure on the heel-driven pedal allows the tension on the biasing element 64 to force the beater 56 back to the starting position.

Figure 11:
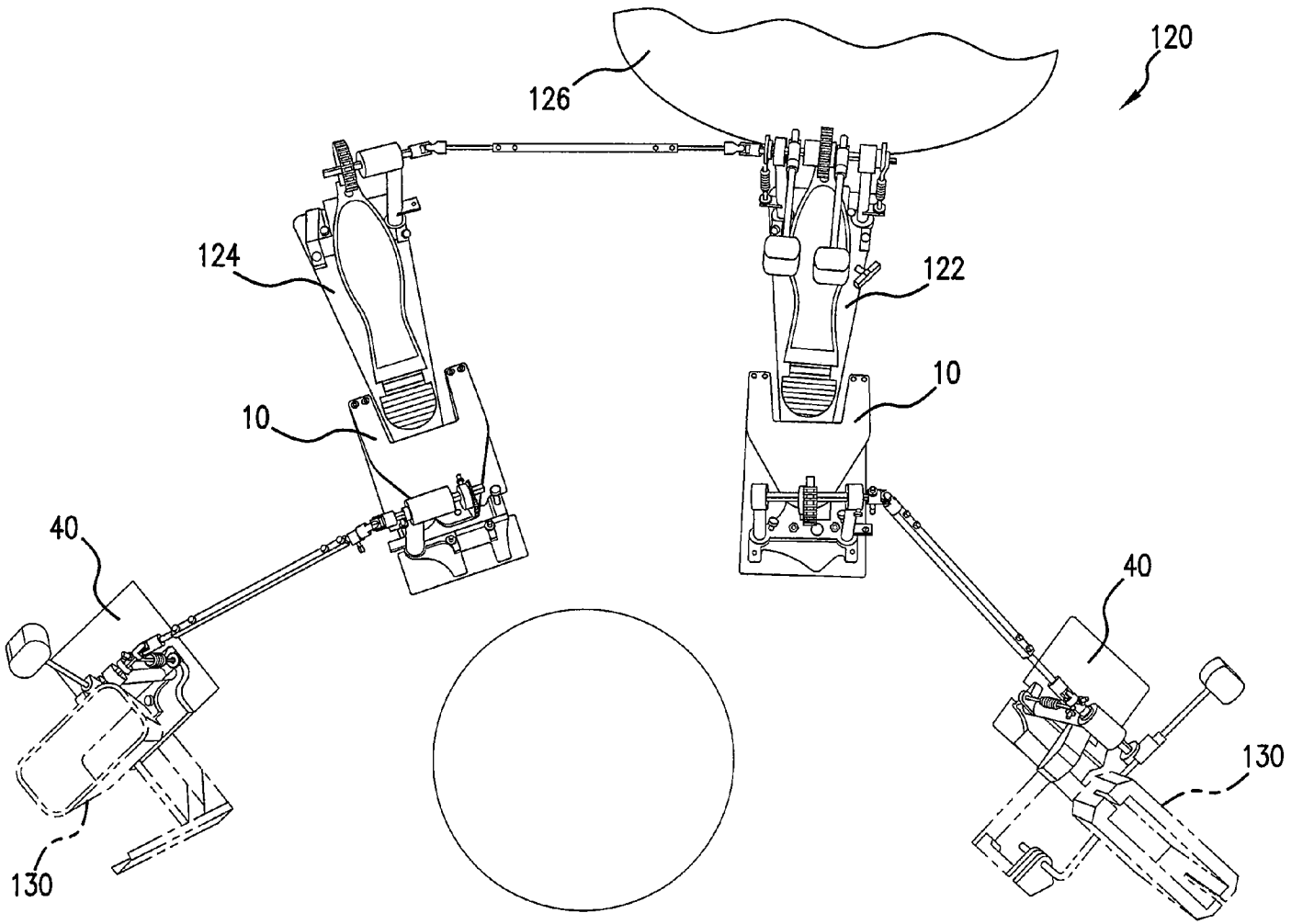
FIG. 11 is a top view of an alternative embodiment of the drum pedal system of this invention.

FIG. 11 shows an embodiment of a system 120 of this invention. In this embodiment, the system 120 includes a right toe-driven pedal 122 and a left toe-driven pedal 124 for a double-bass drum 126. Positioned behind each of the toe-driven pedals is a respective heel-driven pedal 10 that operates a respective beater unit 40 in the method described above. The respective beater units 40 each operating a separate percussions instrument 130 for example, but not limited to, a drum, a block, a cymbal, a hi-hat and a cow bell.

Another advantage of this non-attached concept of the pedal design is that a left foot pedal, for the typical drummer, can also be used on either the original bass drum pedal in a, single bass, double bass application or used on the hi-hat pedal as well. It is plausible that even three or more heel pedals can be used on both bass and hi-hat pedals simultaneously for more multiple voice options.

While in the foregoing specification this invention has been described in relation to certain preferred embodiments thereof, and many details have been set forth for purpose of illustration, it will be apparent to those skilled in the art that the laminate cutter is susceptible to additional embodiments and that certain of the details described herein can be varied considerably without departing from the basic principles of the invention.

What is claimed is:

1. A heel-driven drum pedal system comprising:

a heel-driven pedal including:

a heel board and a base plate connected with a hinge, wherein the heel board includes a heel board cut-out to be placed around a standard toe-driven drum pedal without connecting to the toe-driven drum pedal and the base plate includes a base plate cut-out to be placed around the standard toe-driven drum pedal without connecting to the toe-driven drum pedal;

a pedestal mounted to the base plate at a position opposite the hinge;

a bearing rod rotatably connected to the pedestal;

a sprocket connected to the bearing rod;

a chain extending from the sprocket to the heel board;

a beater unit including:

a beater pedestal mounted to a beater base plate;

a beater bearing rod rotatably connected to the beater pedestal;

a mallet connected to the beater bearing rod; and an extension rod extending from the bearing rod to the beater bearing rod to rotabably join the heel-driven pedal to the beater unit.

2. The heel-driven drum pedal system of claim 1, wherein the bearing rod is rotatably connected to the pedestal with a bearing housing.

3. The heel-driven drum pedal system of claim 1, wherein the beater unit bearing rod is rotatably connected to the beater pedestal with a beater unit bearing housing.

4. The heel-driven drum pedal system of claim 1, wherein the base plate includes a side notch to accommodate a stabilizing spike screw to fix the base plate in a position.

5. The heel-driven drum pedal system of claim 1, wherein the beater base plate includes a beater side notch to accommodate a stabilizing spike screw to fix the beater base plate in a position.

6. The heel-driven drum pedal system of claim 1, wherein the bearing rod connects to a first end of the extension rod with a first universal joint and the beater bearing rod connects to a second end of the extension rod with a second universal joint.

7. The heel-driven drum pedal system of claim 1, wherein the beater bearing rod is attached to a biasing element that biases the beater bearing rod and the mallet in a non-contact position.

8. A heel-driven drum pedal system for playing a primary percussion instrument and a secondary percussion instrument comprising:

a heel-driven pedal including:

a heel board and a base plate connected with a hinge, wherein the heel board includes a heel board cut-out and the base plate includes a base plate cut-out;

a pedestal mounted to the base plate at a position opposite the hinge;

a bearing rod rotatably connected to the pedestal;

a sprocket connected to the bearing rod;

a chain extending from the sprocket to the heel board;

a beater unit including:

a beater pedestal mounted to a beater base plate;

a beater bearing rod rotatably connected to the beater pedestal;

a mallet connected to the beater bearing rod;

an extension rod extending from the bearing rod to the beater bearing rod to rotabably join the heel-driven pedal to the beater unit; and a standard toe-driven drum pedal, wherein the standard toe-driven drum pedal slides into the heel board cut-out and the base plate cut-out without connecting to the heel driven drum pedal.

9. The heel-driven drum pedal system of claim 8, wherein the bearing rod is rotatably connected to the pedestal with a bearing housing.

10. The heel-driven drum pedal system of claim 8, wherein the beater unit bearing rod is rotatably connected to the beater pedestal with a bearing housing.

11. The heel-driven drum pedal system of claim 8, wherein the base plate includes a side notch to accommodate a stabilizing spike screw to fix the base plate in a position.

12. The heel-driven drum pedal system of claim 8, wherein the beater base plate includes a beater side notch to accommodate a stabilizing spike screw to fix the beater base plate in a position.

13. The heel-driven drum pedal system of claim 8, wherein the bearing rod connects to a first end of the extension rod with a first universal joint and the beater bearing rod connects to a second end of the extension rod with a second universal joint.

14. The heel-driven drum pedal system of claim 8, wherein the beater bearing rod is attached to a biasing element that biases the beater bearing rod and the mallet in a non-contact position.

15. A heel-driven drum pedal retro-fit kit for playing a percussion instrument comprising:

a heel-driven pedal including a heel board and a base plate connected with a hinge, wherein the heel board includes a heel board cut-out to be placed around a standard toe-driven drum pedal without connecting to the toe-driven drum pedal; the base plate includes a base plate cut-out where the heel board cut-out and the base plate cut-out are to be placed around the standard toe-driven drum pedal without connecting to the toe-driven drum pedal; a pedestal mounted to the base plate at a position opposite the hinge; a bearing rod rotatably connected to the pedestal; a sprocket connected to the bearing rod; and a chain extending from the sprocket to the heel board; and a beater unit including: a beater pedestal mounted to a beater base plate; a beater bearing rod rotatably connected to the beater pedestal; a mallet connected to the beater bearing rod; and an extension rod extending from the bearing rod to the beater bearing rod to rotatably join the heel-driven pedal to the beater unit.

* * * * *